US008887478B2

(12) United States Patent
Lachenmeier et al.

(10) Patent No.: US 8,887,478 B2
(45) Date of Patent: Nov. 18, 2014

(54) CROSS ROPING

(75) Inventors: Per Lachenmeier, Sonderborg (DK); Martin Schwaps, Bollingstedt (DE); Alice Holm Kristensen, Sydals (DK)

(73) Assignee: Premark Packaging LLC, Glenview, IL (US)

( * ) Notice: Subject to any disclaimer, the term of this patent is extended or adjusted under 35 U.S.C. 154(b) by 0 days.

(21) Appl. No.: 13/825,215

(22) PCT Filed: Sep. 23, 2011

(86) PCT No.: PCT/US2011/052947

§ 371 (c)(1), (2), (4) Date: Mar. 20, 2013

(87) PCT Pub. No.: WO2012/040568

PCT Pub. Date: Mar. 29, 2012

(65) Prior Publication Data

US 2013/0180214 A1 Jul. 18, 2013

(30) Foreign Application Priority Data

Sep. 24, 2010 (DE) ..... 10 2010 037 770

(51) Int. Cl.
*B65B 11/00* (2006.01)
*B65B 9/13* (2006.01)

(52) U.S. Cl.
CPC ..... *B65B 11/00* (2013.01); *B65B 9/135* (2013.01)
USPC ..... 53/461; 53/399; 53/582

(58) Field of Classification Search
CPC ..... B65B 11/00; B65B 9/135
USPC ..... 53/399, 461, 582, 585, 589, 590
See application file for complete search history.

(56) References Cited

U.S. PATENT DOCUMENTS

| | | | | | |
|---|---|---|---|---|---|
| 4,204,377 | A | * | 5/1980 | Lancaster et al. | 53/399 |
| 4,235,062 | A | * | 11/1980 | Lancaster et al. | 53/399 |
| 4,754,594 | A | * | 7/1988 | Lancaster | 53/399 |
| 4,905,451 | A | * | 3/1990 | Jaconelli et al. | 53/410 |
| 5,107,657 | A | * | 4/1992 | Diehl et al. | 53/141 |
| 5,195,297 | A | | 3/1993 | Lancaster et al. | |

(Continued)

FOREIGN PATENT DOCUMENTS

EP 2199214 A1 6/2010

OTHER PUBLICATIONS

International Search Report and Written Opinion corresponding to PCT/US2011/052947, dated Dec. 21, 2011.

*Primary Examiner* — Hemant M Desai
(74) *Attorney, Agent, or Firm* — Lowe Hauptman & Ham

(57) ABSTRACT

The present invention relates to a method for at least partially wrapping a piece-goods stack, in which a tubular portion is pulled over the piece-goods stack, and to an apparatus for carrying out the method according to the invention. The method according to the invention is distinguished in particular in that, during the pulling of the tubular portion over the piece-goods stack, pleats are produced in a specific manner in the tubular portion, said pleats extending obliquely over at least one side of the goods stack. The invention is achieved in terms of the apparatus in that the apparatus has a reefing device for reefing and/or drawing over the tubular portion, said reefing device being configured in such a manner that it reefs and/or unreefs regions of the tubular portion at different speeds and/or at different times.

25 Claims, 10 Drawing Sheets

(56) References Cited

U.S. PATENT DOCUMENTS

| | | | | |
|---|---|---|---|---|
| 5,216,871 | A * | 6/1993 | Hannen | 53/556 |
| 5,463,843 | A * | 11/1995 | Sharp | 53/399 |
| 7,707,802 | B2 * | 5/2010 | Forrest | 53/399 |
| 7,908,831 | B1 * | 3/2011 | Dugan | 53/587 |
| 2009/0217624 | A1 * | 9/2009 | Forrest | 53/399 |
| 2009/0229226 | A1 * | 9/2009 | Beeland et al. | 53/450 |
| 2010/0163443 | A1 * | 7/2010 | Storig et al. | 206/223 |
| 2011/0258973 | A1 | 10/2011 | Czok et al. | |

* cited by examiner

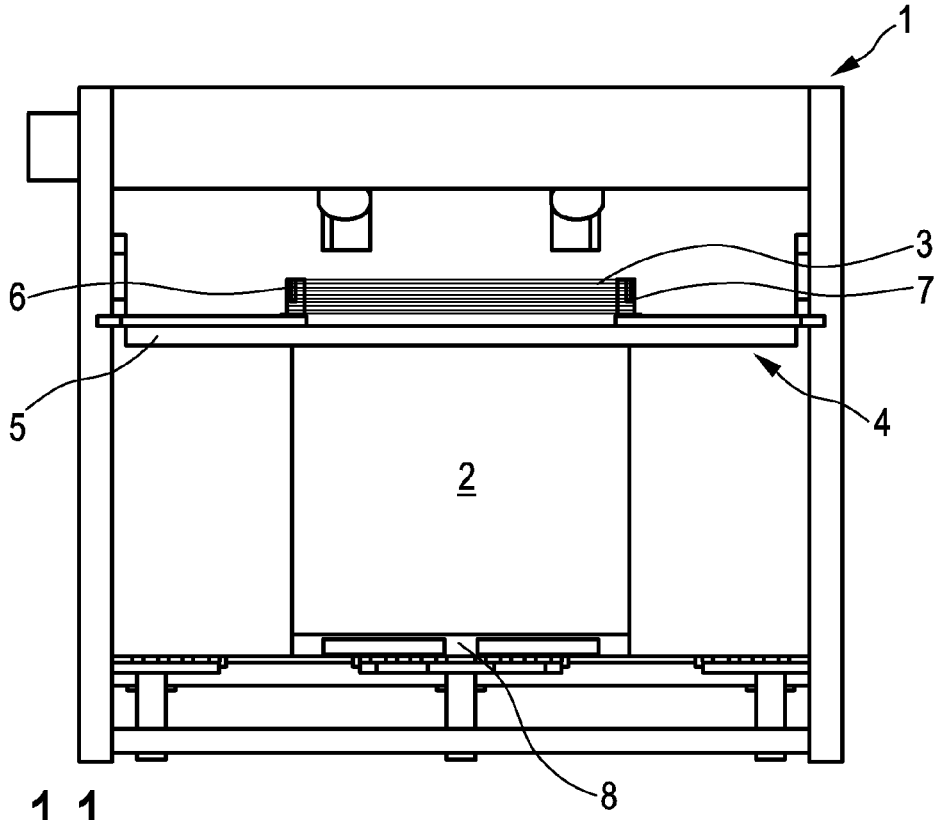
Fig. 1.1
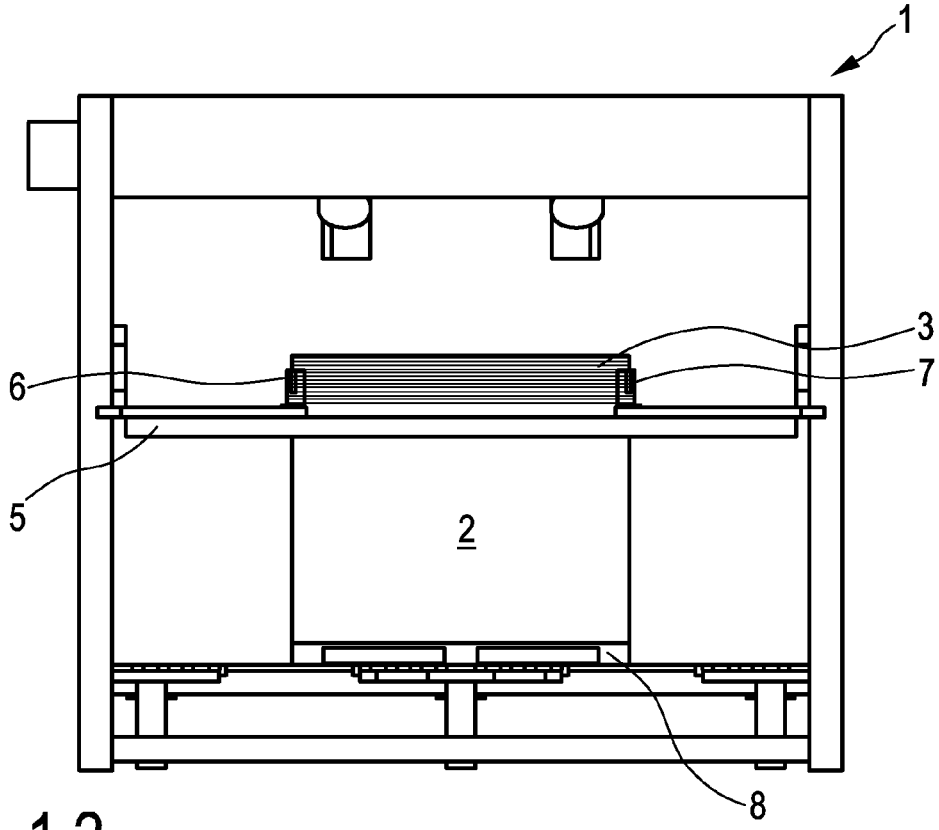
Fig. 1.2

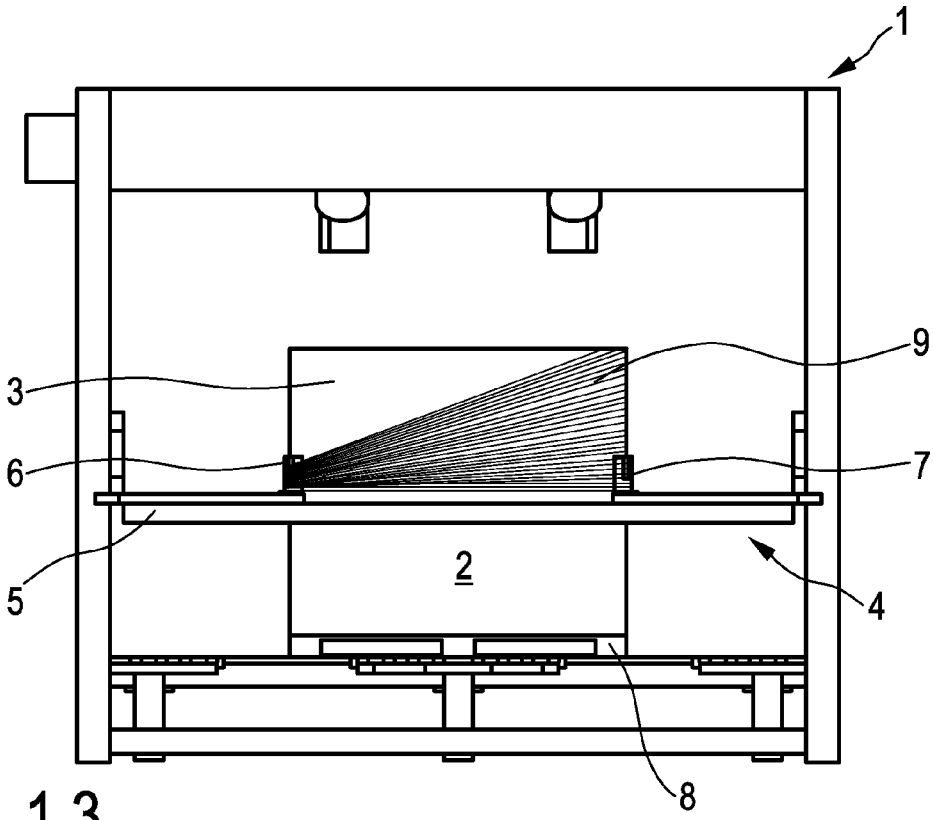
Fig. 1.3
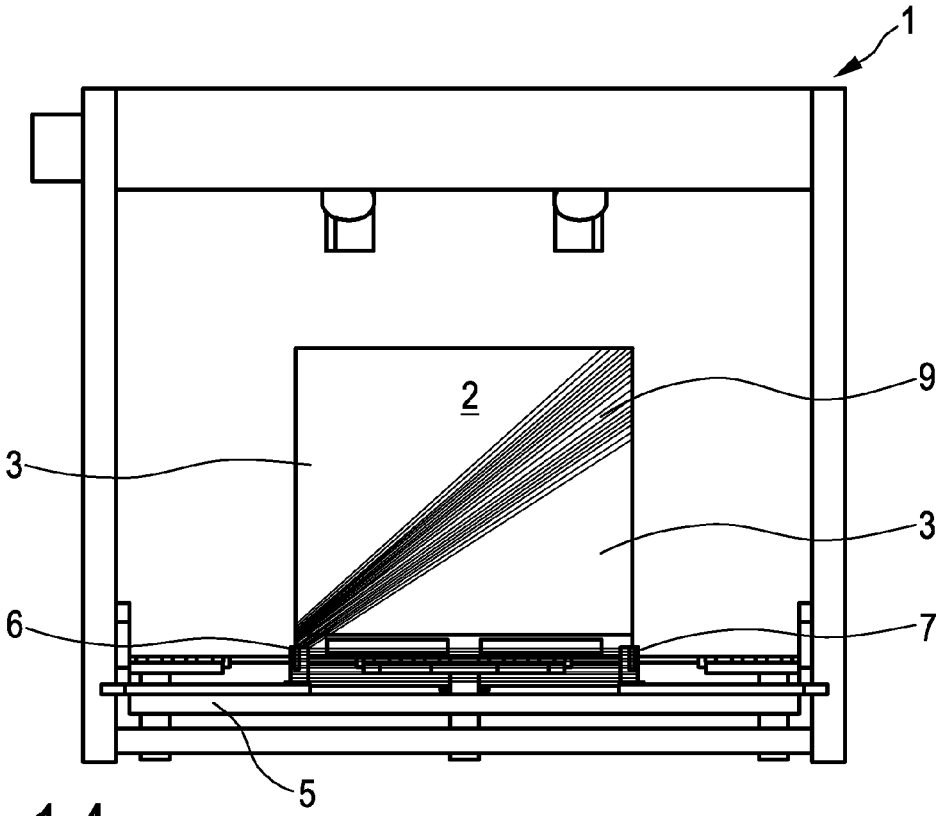
Fig. 1.4

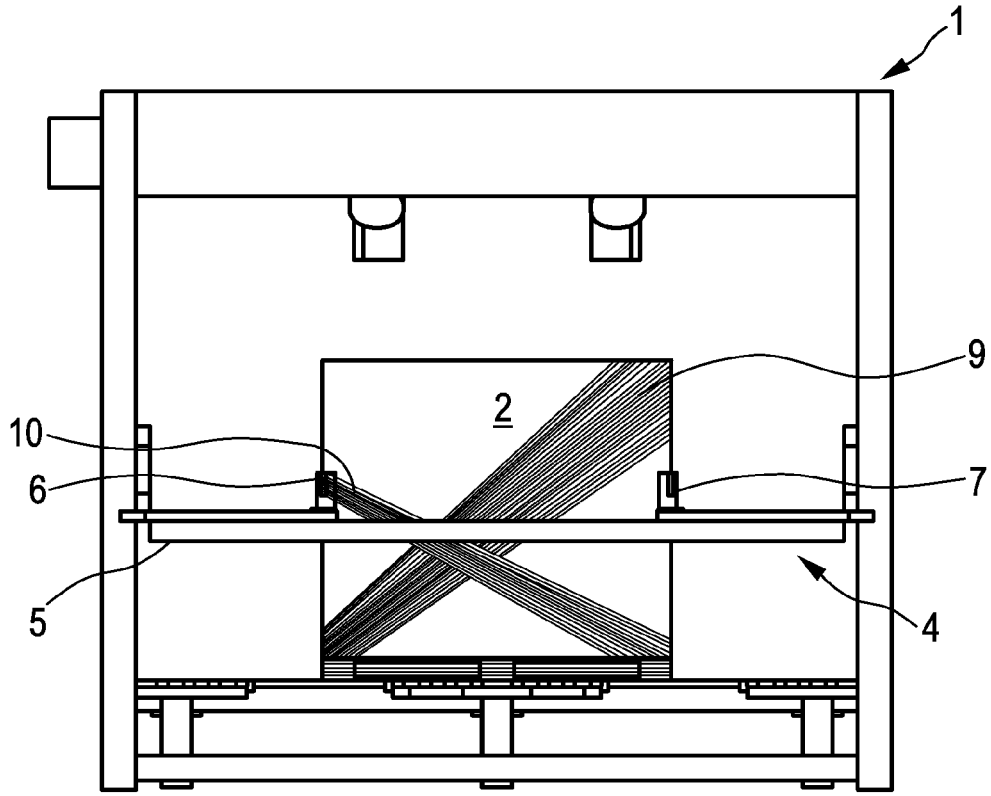
Fig. 1.5
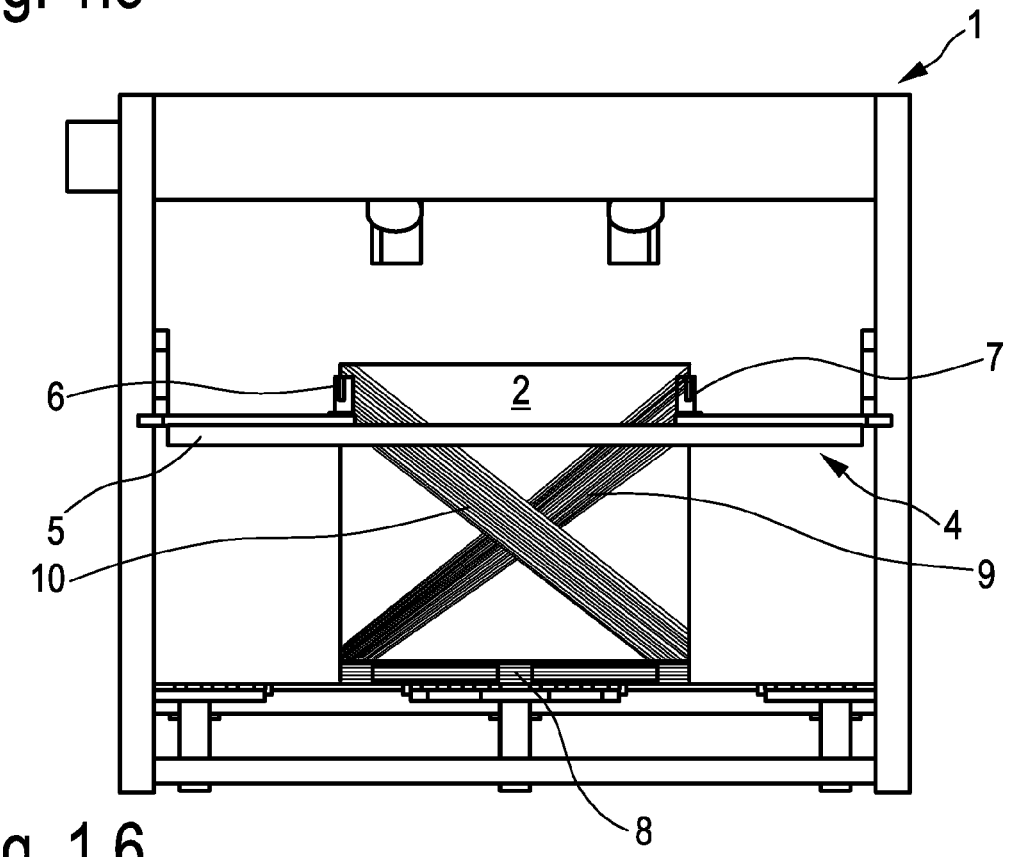
Fig. 1.6

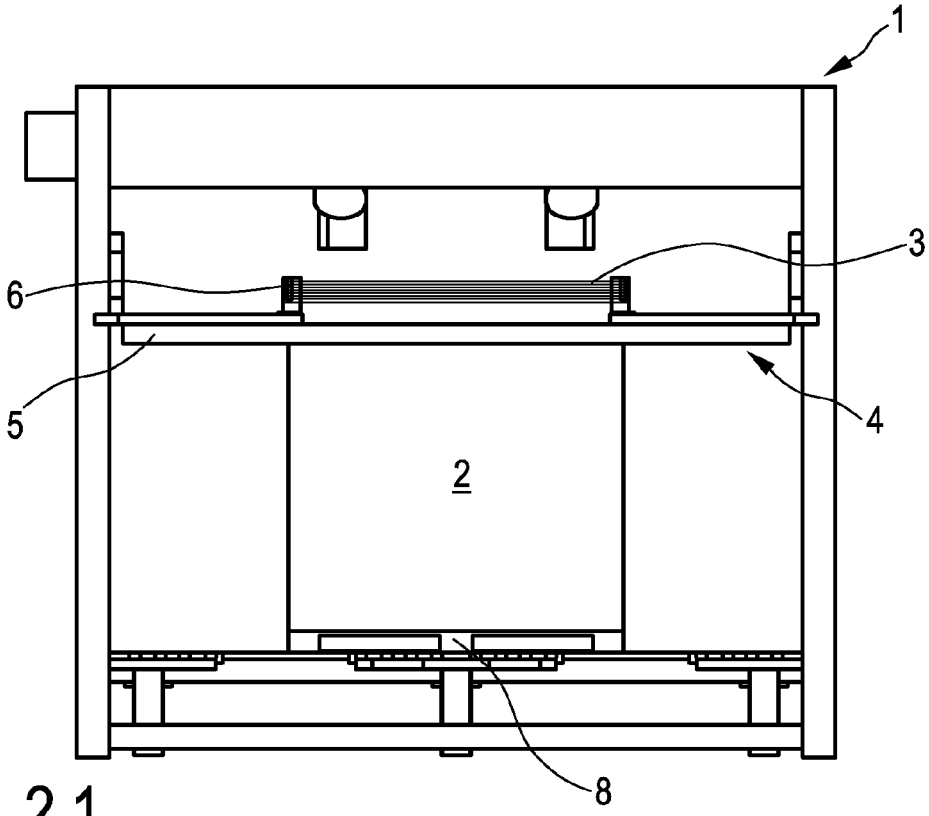
Fig. 2.1
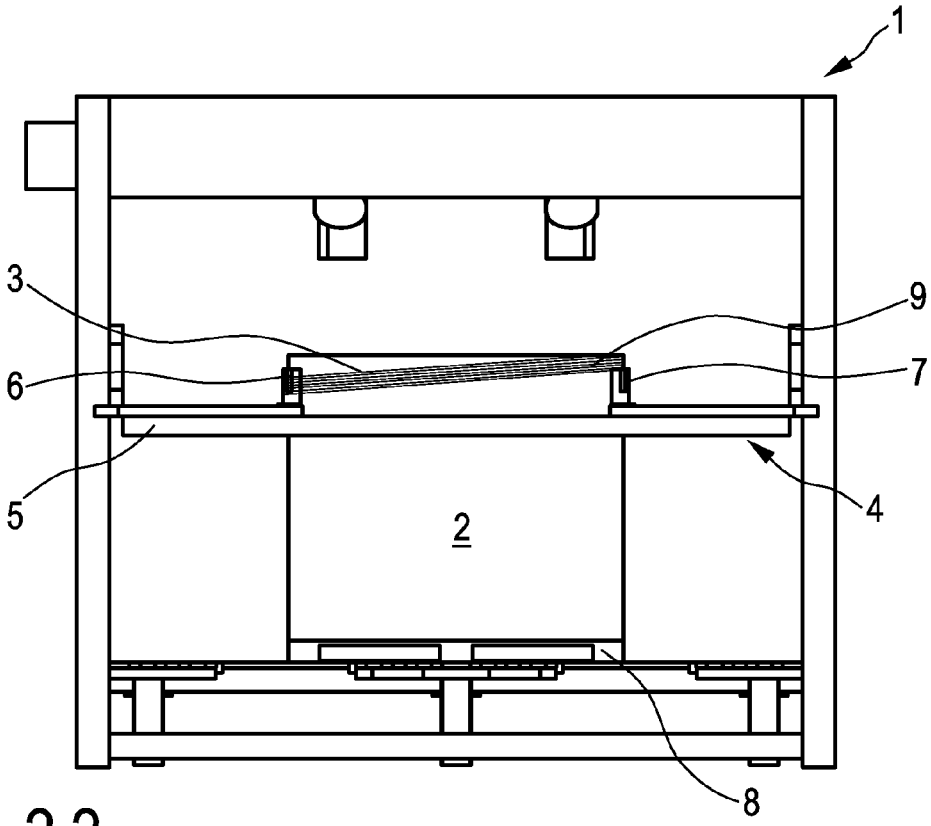
Fig. 2.2

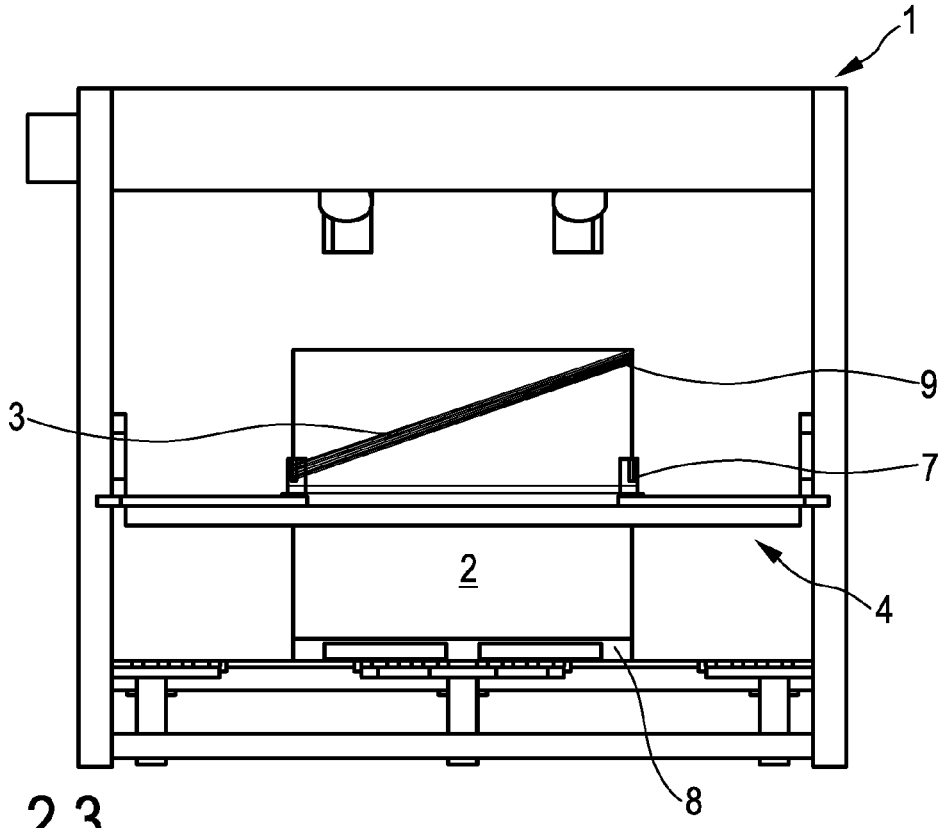
Fig. 2.3
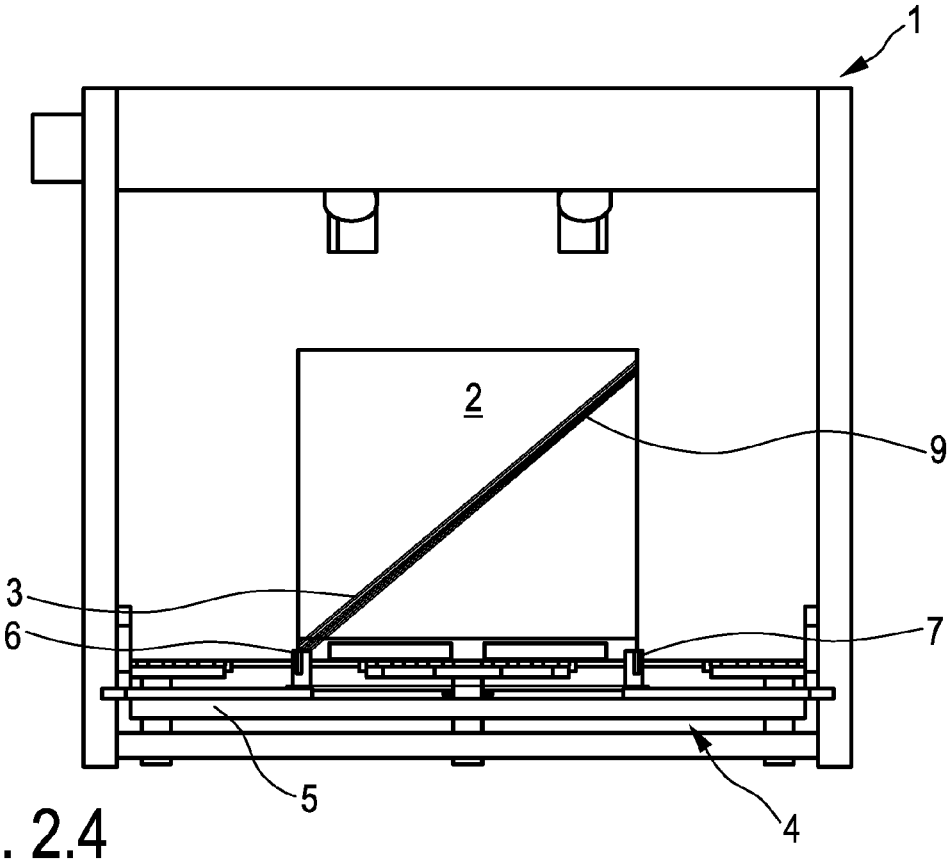
Fig. 2.4

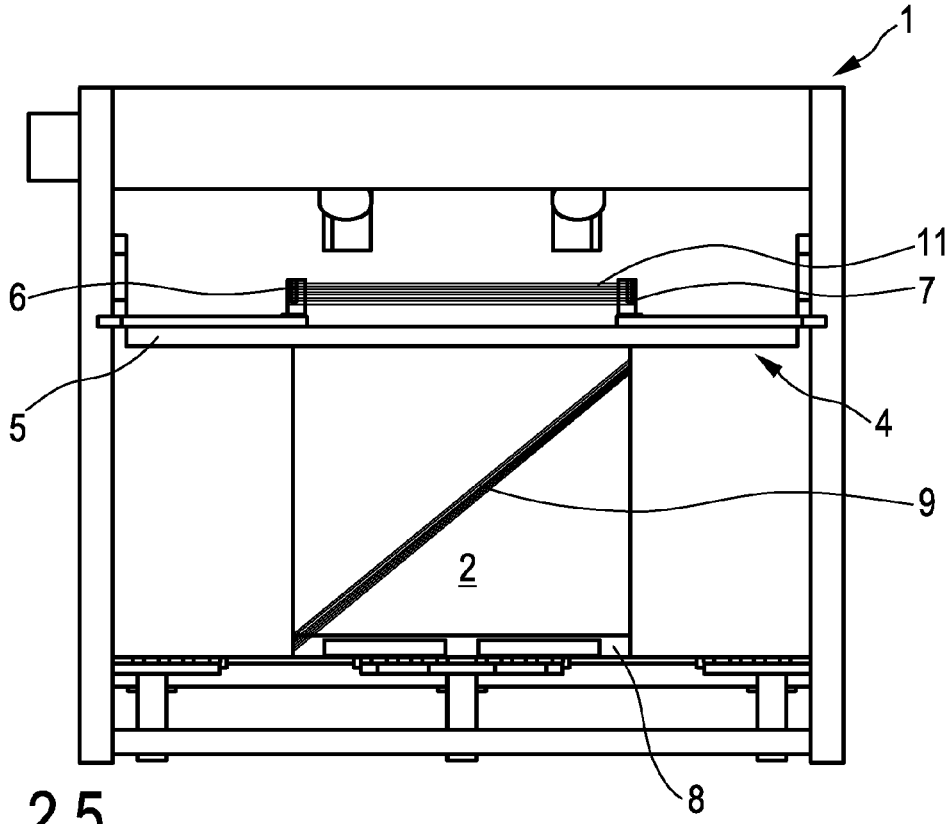
Fig. 2.5
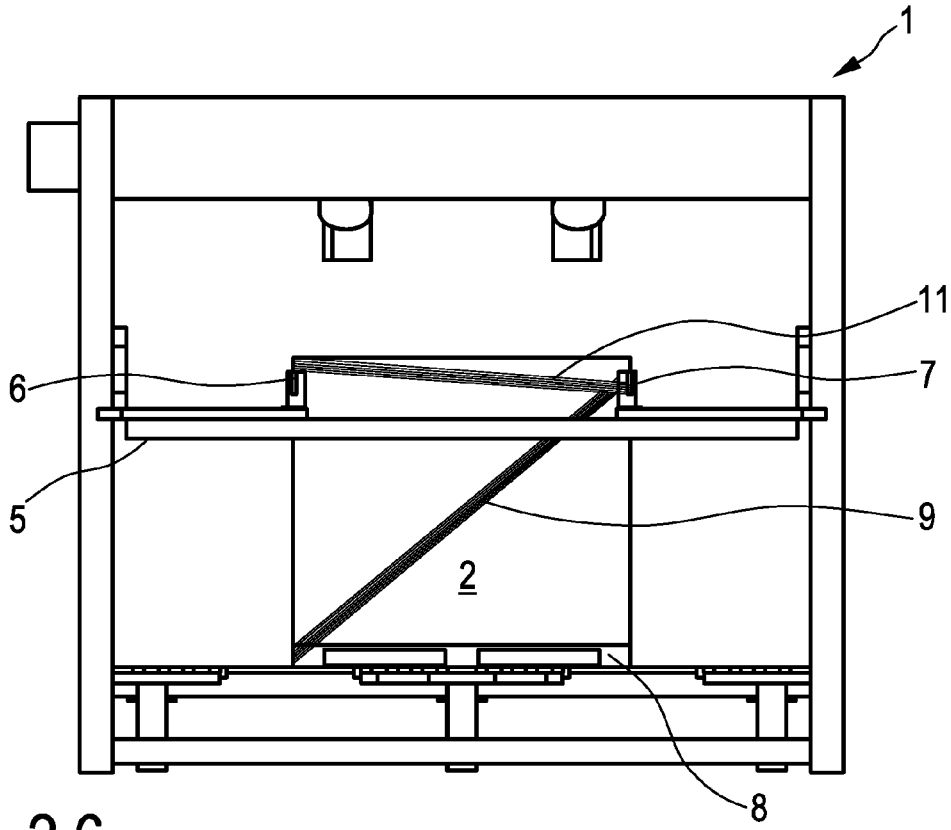
Fig. 2.6

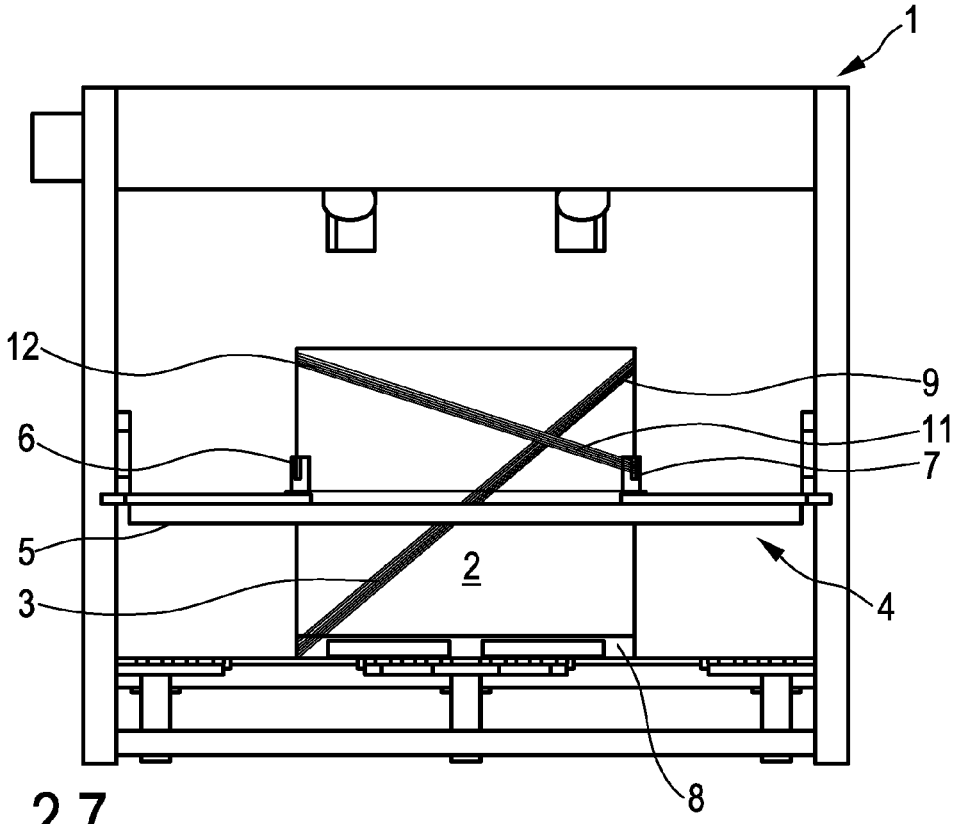
Fig. 2.7
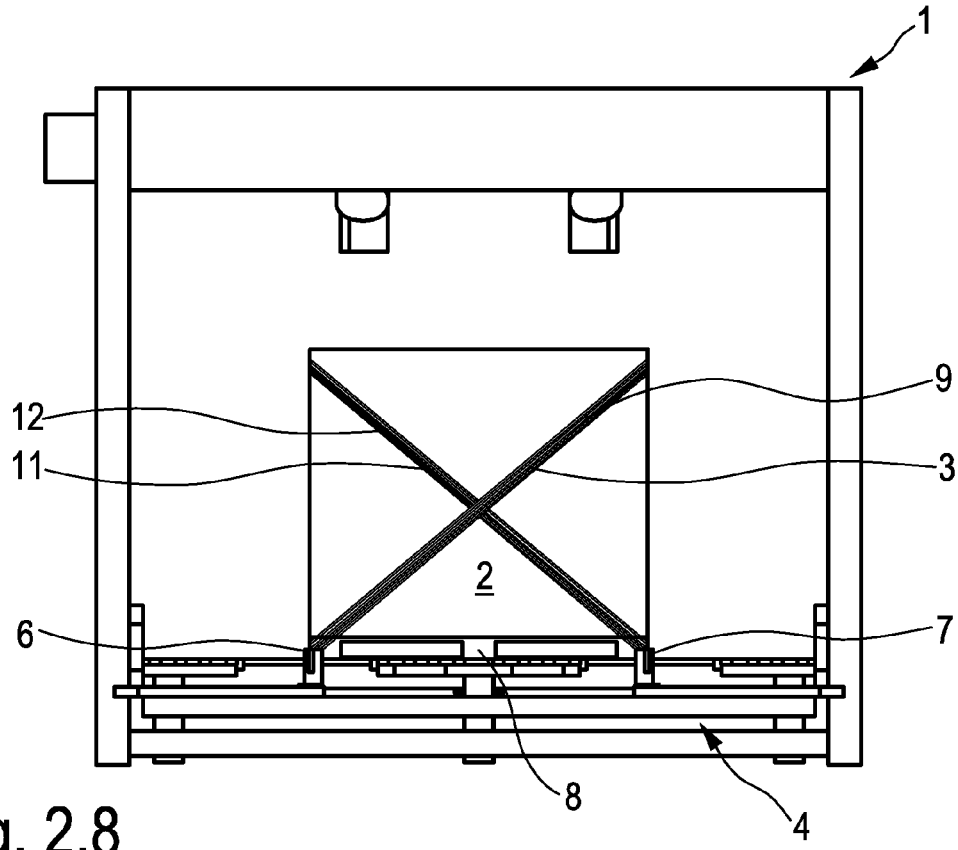
Fig. 2.8

CROSS ROPING

RELATED APPLICATIONS

The present application is a National Phase of International Application Number PCT/US2011/052947, filed Sep. 23, 2011, and claims priority from German Application Number 102010037770.8, filed Sep. 24, 2010.

BACKGROUND

The present invention relates to a method and to an apparatus for at least partially wrapping a piece-goods stack, in which a tubular portion is pulled over the piece-goods stack.

Methods and apparatuses of this type are known. What is referred to as a hood stretching method or else a hood shrinking method may be involved. Both methods are distinguished in that a tubular portion consisting of a tubular film is pulled or pushed over any item of freight, referred to below as piece-goods stack, and is brought to bear thereagainst. In this case, the corresponding tubular portions may be in the manner of a hood, i.e. closed at the top, or in the manner of a band, i.e. open at the top. The tubular portions serve in particular to secure the position of the individual item of freight or of the entire piece-goods stack. Thereby, the piece-goods stack can be secured on, respectively at a pallet. However, pallet-free piece-goods stacks which are connected with the aid of the tubular portion to form more easily handleable loading units are also conceivable.

In the shrinking method, use is made of a tubular portion which has a larger diameter than the circumferential extent of the piece-goods stack. Said tubular portion is pulled over the piece-goods stack and shrunk onto the piece-goods stack by means of the action of heat. In the stretching method, use is made of a tube, the diameter of which is smaller than the circumference of the piece-goods stack. The tube is then expanded by suitable stretching means such that it can be pulled or pushed over the piece-goods stack. Solutions are also known, in which the piece-goods stack is pushed into the reefed tubular portion by means of an elevating platform. All of this is intended to be covered by the subject matter of the application. After being drawn over, the tubular portion is released and, by means of the elastic resetting force thereof, keeps the piece-goods stack together or secures the latter at the pallet.

The known stretching or shrinking installations share the problem that the piece-goods stacks consisting of relatively rough and/or stable piece goods, for example cartons, are held relatively well by the particular tubular portion, in particular if the tubular portion is configured in the manner of a hood. However, it has been shown time and again that it would be desirable for the piece-goods stacks to be held together even more strongly, in particular if they involve relatively loose or heavy loads, for example loads of stones, or flexible piece goods, for example beverage bottles made of plastic, in which the beverage does not contain any carbon dioxide. It is specifically loose, heavy and/or flexible piece-goods which need to be secured in position particularly well, this frequently not being possible to obtain in the past in a satisfactory manner using the known packaging methods and packaging apparatuses.

OBJECT OF THE INVENTION

The invention is therefore based on the object of specifying a method and an apparatus for at least partially wrapping a piece-goods stack, which method and apparatus use as simple means as possible to particularly effectively and reliably secure the position even of relatively flexible piece goods.

The invention is achieved by the method as claimed in claim 1 and by the apparatus as claimed in claim 14. Advantageous developments of the invention are specified in the dependent claims.

The method according to the invention for at least partially wrapping a piece-goods stack, in which a tubular portion is fixed to the piece-goods stack, is therefore distinguished in that the tubular portion is fixed to the piece-goods stack in such a manner that, during the fixing operation, pleats are produced in the tubular portion, said pleats extending obliquely over at least one side of the piece-goods stack. In a complete break from the previously prevailing opinion, according to which, in the corresponding stretching or shrinking methods, the tubular film portions are intended to be pulled over the piece-goods stack in a manner as free as possible from pleats, specific pleating is now obtained in a specific manner. Pleating is intended to be understood here as meaning at least one pleat, but preferably a plurality of essentially parallel pleats. A pleat may be understood here as meaning a portion in which the tubular portion undergoes at least one change in direction and, as a result, an accumulation of material is produced at this point on the piece-goods stack.

Said pleats are intended to extend obliquely over at least one side of the goods stack, this, in other words, leading to a diagonal concentration of tubular material in the region of the pleats. There is therefore more tubular material in the region of the pleats than where there are no pleats, as is normally the case in the known methods. Said additional tubular film material ensures that greater tensile forces can be absorbed by the tubular portion both in the horizontal and in the vertical direction. In this respect, the individual parts of the piece-goods stack are held substantially more securely specifically also in relation to horizontal displacement.

The sides of the piece-goods stack involve any conceivable side of the piece-goods stack, for example the longitudinal sides, end sides or upper sides of the piece-goods stack.

The tubular portion is expediently pulled or pushed at least partially in a number of layers over the piece-goods stack or fixed in some other manner by the tubular portion first of all being pulled and/or pushed over the piece-goods stack in a first drawing-over direction and then in an opposed, second drawing-over direction and subsequently optionally with further changes in direction. In this case, the tubular portion is therefore longer than the height of the region with which said tubular portion comes to directly bear against the piece-goods stack. A plurality of pleatings can be obtained by the tubular portion being guided to and fro along the piece-goods stack.

It is of particular advantage in this connection if, following a change in the drawing-over direction, the orientation of the pleats in the tubular portion is changed. For example, when the film is moved downward over the stack, the side pleats can first of all be formed obliquely from the top to obliquely at the bottom while, during the subsequent guiding upward of the tubular portion, the pleats at the sides are guided from obliquely at the bottom to obliquely at the top. This results in a cross-like pleated pattern on the relevant side of the piece-goods stack. However, it is also conceivable for the pleats to be produced on a different side of the piece-goods stack after the change in direction.

Since a tubular film can in particular absorb tensile forces, the changed arrangement and orientation of different pleatings on the piece-goods stack results in a particularly secure position of the piece-goods stack in a spatial respect, by means of spatially distributed and/or oriented tension straps.

In a development, at least one further tubular portion is fixed on the piece-goods stack in such a manner that said tubular portion as far as possible has no pleats. Said tubular portion then serves in particular to seal off the piece-goods stack from environmental influences, such as moisture, etc. However, said tubular portion also has an effect on the additional securing in position, and serves in particular, when drawn over a portion with pleating, to produce an outer wrapping which is as flat as possible. Flat outer wrappings produce a high-quality effect and can more easily be printed.

As an alternative or in addition to the previously described embodiments of the method according to the invention, a further tubular portion can be pulled over the piece-goods stack in such a manner that oblique pleats are also produced in said tubular portion, the pleats preferably extending in a different direction from the pleats of the first tubular portion, which has oblique pleats. In contrast to the portion guided to and fro, as has been previously described, at least two separate tubular portions are used here. The at least one further tubular portion can be arranged on a tubular portion which is pulled smooth per se, or else on a tubular portion already having oblique pleats.

The additional tubular portion may also be arranged on a first tubular portion which is already applied in multiple layers. It always serves to further reinforce the securing of the position of the piece-goods stack and is arranged in particular whenever the piece-goods stack is intended to be secured particularly effectively against slipping or twisting, for example because it is particularly high.

It is also of particular advantage here if the pleats of one tubular portion arranged over another extend in a crosswise manner to the pleats of the other tubular portion.

Furthermore, it is advantageous if at least one tubular portion is bonded to form a hood and is pulled over the piece-goods stack in the manner of a hood and nevertheless has the pleats according to the invention. It is thus possible, even with a single tubular portion, to obtain a good vertical and horizontal securing in position, with the piece-goods stack being protected at the same time against environmental influences, for example rain. In this respect, this embodiment of the method according to the invention is also comparatively rapid and readily suitable if the piece-goods stacks are to be packed at as high a speed as possible.

As an alternative or in addition, at least one tubular portion is fixed on the piece-goods stack in the manner of a band. A band is intended to be understood here as meaning a tubular portion which is open on the front faces thereof, and in this respect covers at least partial regions of the circumference of the piece-goods stack.

In a development, the pleats are produced in the tubular portion in such a manner that the width thereof changes over the side of the piece-goods stack. This change in width of the pleats arises in particular whenever the tubular portion is unreefed at differing speeds during the drawing-over process. This can be used to reduce stress concentrations at certain points of the piece-goods stack by the pleating being relatively wide there.

Under certain circumstances, it may be advantageous for the pleats to be produced only in a partial region of the tubular portion. For example, the pleated appearance can be produced only in a lower region of the piece-goods stack. However, it is also conceivable for the formation of pleats to be arranged specifically only in another region, for example at the top or in the center of the piece-goods stack or of the tubular portion, since, in these regions, particular requirements arise regarding the securing of the piece-goods stack in position.

The pleats are preferably produced in the tubular portion with the use of a reefing device which reefs and/or unreefs regions of the tubular portion at different speeds and/or at different times. In particular, at least two parts of the reefing device are intended to be activatable separately in such a manner that at least one side of the tubular film portion is reefed and/or unreefed with a certain time delay in relation to the other side of the tubular portion.

However, a prerequisite therefor is that the existing reefing device permits unreefing from the different reefing fingers thereof at different speeds and at different times.

The object is achieved in terms of the apparatus by the apparatus as claimed in claim 13, which has at least one reefing device for reefing and/or drawing over a tubular film portion, and which is configured according to the invention in such a manner that it reefs and/or unreefs at least regions of the tubular portion at different speeds and/or at different times.

In a development, the reefing device has, according to the invention, at least two motors for reefing and unreefing the tubular portion, which motors can be activated separately. The two reefing motors are not intended to be synchronized but rather—on the contrary—can be activated separately in terms of the operation thereof.

It may also be expedient if the reefing device has a two-part reefing frame (optionally also divided into yet more parts), the frame halves of which can be moved in the vertical direction separately from each other. An apparatus of this type can be activated by the control system in such a manner that different pleatings are produced simultaneously on all four lateral sides of the piece-goods stack during the drawing-over process. The apparatus according to the invention is therefore distinguished by a high degree of variability which also leads to an increase in efficiency of the packaging installation, since reinforcing pleats can already be produced simultaneously in an extremely different orientation on all four sides of the piece-goods stack.

Furthermore, the reefing device can be configured in such a manner that it picks up a plurality of tubular portions and manipulates the latter in a drawing-over operation. For example, a first tubular portion can first of all be reefed in a lower region of the reefing device, then a second tubular portion can be reefed in a region located thereabove and only then would the reefing device, or a separate drawing-over apparatus which may be present, bring the two tubular portions to bear successively against the piece-goods stack. This configuration of the apparatus therefore permits a particularly rapid production in particular of cross-shaped pleatings with the aid of two or more tubular portions.

Furthermore, it may be advantageous if the reefing device has at least one individually movable reefing finger. In particular, however, it is also expedient if all of the reefing fingers are movable individually. This ensures the greatest possible flexibility in adapting the reefing device to the particular packaging situation. For example, it is possible for the operation to be carried out with only three reefing fingers. The individual movability (as far as possible both in the horizontal and vertical direction) also ensures that even the most complicated pleatings can be realized, for example, with asymmetrical pleats.

BRIEF DESCRIPTION OF THE DRAWINGS

The invention is intended to be explained in more detail below with reference to further exemplary embodiments which are shown in the drawing. Schematically in the drawings:

FIGS. 1.1-1.6: show a first exemplary embodiment of the invention, in which a single tubular portion is fixed to the piece-goods stack;

FIGS. 2.1-2.8: show a second exemplary embodiment of the invention, in which two tubular portions are fixed one above the other to the piece-goods stack;

DETAILED DESCRIPTION OF THE INVENTION

Figure 3:
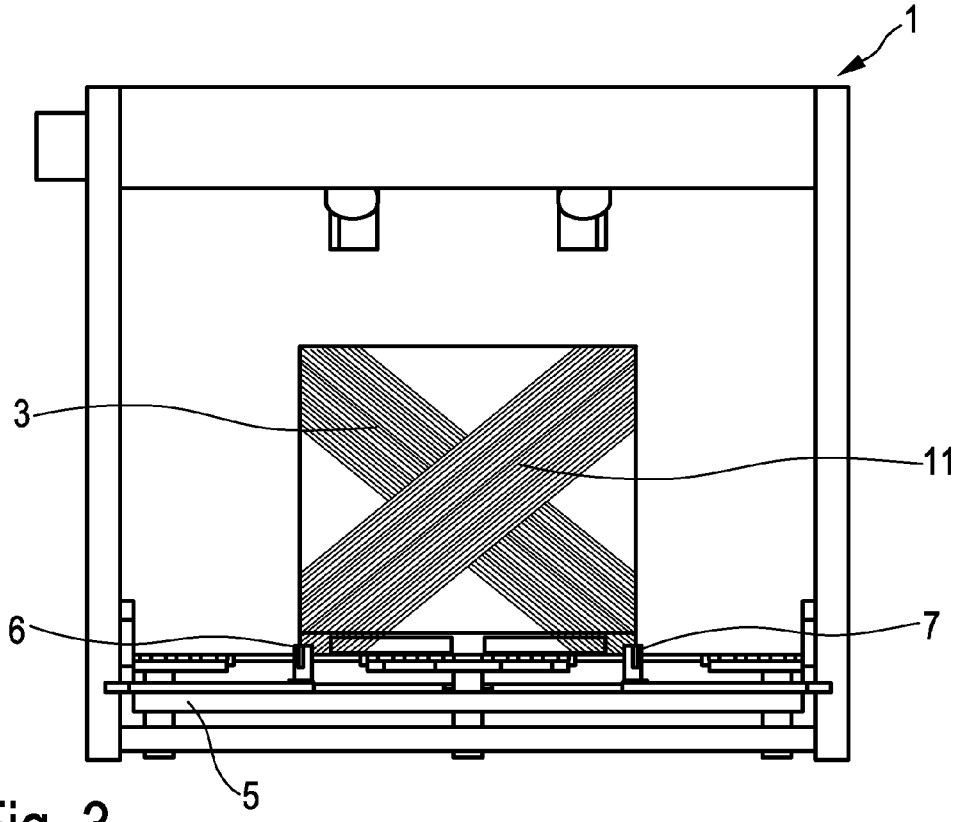
FIG. 3: shows a third exemplary embodiment of the invention, in which a relatively wide pleating is produced.

The apparatus as shown in FIG. 1 to FIG. 5 is an exemplary embodiment of an apparatus 1 according to the invention which operates in accordance with the stretch method and is intended for at least partially wrapping a piece-goods stack 2 with a tubular portion 3, and which has at least one reefing device 4 for reefing and/or drawing over the tubular portion 3.

The reefing device 4, for its part, has a single-part reefing frame 5 which can be moved in the vertical direction to draw over the hood. Four reefing fingers which are movable in the horizontal direction and therefore serve to reef and stretch the tubular portions 3 are arranged on the reefing frame 5. The left reefing fingers 6 are located on the left side and the right reefing fingers 7 are located on the right side. Since the illustrations in FIG. 1 to FIG. 5 involve side views, the rear reefing fingers 6, 7 in each case are covered by the reefing fingers 6, 7 located at the front. Each reefing finger is assigned a respective reefing roller (not illustrated here), said reefing rollers serving to reef or unreef the tubular film portion 3 onto or from the individual reefing fingers 6, 7.

The apparatus 1 has two drives (not shown specifically here), one for the left reefing fingers 6 and one for the right reefing fingers 7, which drives can be activated separately from each other. In this respect, the apparatus 1 can be operated according to the invention in such a manner that a particular tubular portion 3 can be reefed onto and unreefed from the left and from the right reefing fingers 6, 7 at different times and at different speeds. This permits the realization of the different embodiments, which are shown in FIG. 1 to FIG. 6, of the method according to the invention.

The different embodiments of the method according to the invention are now described below. FIG. 1 shows different method sections of a first exemplary embodiment of the method according to the invention in FIGS. 1.1 to 1.6. In said method, the single tubular portion 3 is pulled over the piece-goods stack 2. The piece-goods stack 2 which is mounted on a pallet 8 is located for this purpose in the apparatus 1. A tubular portion 3 here is first of all reefed uniformly onto the reefing frame 5 and onto the reefing fingers 6, 7 and cut to size. In the present exemplary embodiment, said tubular portion has been bonded by a cutting and bonding apparatus (not shown specifically here) on the apparatus 1 to form a closed hood.

The reefing device 4 now moves with the reefing frame 5 thereof and with the tubular portion 3 mounted on the reefing fingers 6, 7 from the top (see FIG. 1.1) downward (see FIG. 1.2, FIG. 1.3 and FIG. 1.4) in order to pull said tubular portion over the piece-goods stack 2. During the downward movement of the reefing frame 5, the reefing rollers of all of the reefing fingers 6, 7 are initially still stationary for a short moment. From the height shown in FIG. 1.2, the left side of the reefing device 4, i.e. the reefing rollers of the reefing fingers 6, therefore first of all begins to unroll film while the rollers of the right reefing fingers 7 are not yet being driven. From the height shown in FIG. 1.3, the reefing rollers of the right side, i.e. those of the reefing fingers 7, also begin to unroll tube at the same speed as the fingers 6. Therefore, a plurality of pleats 9 running obliquely from the top on the right to obliquely at the bottom on the left are produced in the tubular portion 3 only owing to the nonuniform beginning of the unreefing of the film portion 3 on the side of the piece-goods stack 2. The first pleated pattern produced in this manner is referred to below as the first pleating 9.

When the reefing device 4 reaches the lowermost point of the piece-goods stack 2 or the lowermost end of the pallet 8, the reefing frame 5 of the reefing device 4 remains stationary for a short moment. All of the reefing rollers 6, 7 are stopped at this time. Since, however, differing amounts of film material are then located on the reefing device 4 and on the reefing frame 5 on both sides, it now suffices for the reefing fingers 6, 7 to be driven synchronously when the reefing frame 5 is moved upward, in order then to produce a second pleating 10 in the tubular portion 3, said pleating being oriented in a cross-shaped manner to the first pleating 9. This can be seen in FIG. 1.5 and FIG. 1.6. If the reefing frame 5 reaches the highest point of the piece-goods stack 2, the remaining part of the tubular portion 3 is now unrolled from the reefing fingers 6 and brought to bear against the goods stack 2.

By contrast with the first embodiment, the second exemplary embodiment, which is shown in FIG. 2, of the method according to the invention is distinguished in that two separate tubular portions 3 and 11 are each unreefed here for a short distance and are then pulled obliquely over the piece-goods stack. This gives rise to relatively narrow, band-like structures which, pulled over each other, form a cross of tubular portions.

This takes place specifically such that, first of all, as shown in FIG. 2.1, a first tubular portion 3 is reefed onto the reefing device 4 and is then moved with the reefing frame 5 over the goods 2 to be packaged. In the exemplary embodiment illustrated here, the tubular portion 3 is, as stated, a type of band, i.e. is an open tubular portion, the upper side of which has not been closed.

From the height shown in FIG. 2.2, only the reefing rollers of the right reefing fingers 7 initially begin to completely unroll the tubular portion 3. The left reefing rollers 6 are stationary at this time. The entire part of the tubular portion 3 thus already rests on the right side of the piece-goods stack 2 while the tubular portion 3 still rests on the left reefing finger 6 on the left side.

As shown in FIG. 2.3, the reefing device 4 then moves downward with the reefing frame 5 thereof. During this, the reefing rollers at the reefing fingers 6 and 7 are stationary, tubular material still resting only on the left reefing finger 6. By means of this holding of the tube supply, the tubular portion 3 is pulled obliquely downwards on the left. A first pleating 9 begins to be produced in the tubular portion 3, the pleating extending obliquely over the piece-goods stack 2.

The reefing frame 5 is moved as far as the point which is shown in FIG. 2.4 and at which the lowermost end of the film or tubular portion 3 should have been placed. The height is freely selectable and adjustable per se. At the lowermost point which is shown here, the tubular portion 3 is located level with the pallet 8. This ensures that the piece-goods stack 2 is secured to the pallet 8 by means of the tubular portion 3. The left part of the tubular portion 3 is completely unrolled here from the reefing fingers 6, 7 and comes with the lowermost end thereof to bear against the pallet 8.

Then, as shown in FIG. 2.5, the reefing device 4 with the reefing frame 5 and the reefing fingers 6, 7 located thereon is moved upward. The reefing device 4 picks up a second tubular portion 11 there, as shown in FIG. 2.5. The second tubular portion 11 has also been reefed beforehand uniformly onto the frame 5, i.e. onto the fingers 6, 7 using reefing wheels running simultaneously and at the same speed.

The reefing frame 5 then moves downward. Somewhat above the position shown in FIG. 2.6, the complete unreefing of the left side of the tubular portion 11 begins, in a similar manner as in FIG. 2.2, but the other way around, namely such that the reefing rollers of the left reefing fingers 6 are now driven first of all while the reefing rollers of the right fingers 7 are stationary. As a result, a first pleating 12 is produced in the left part of the second tubular portion 11.

The reefing frame 5 then moves downward, see FIG. 2.7. The reefing rollers are again stationary on both sides here such that the tubular portion 11 is pulled obliquely downward on the right.

At the lowermost end of the pallet 8, which end is shown in FIG. 2.8, the right part of the second tubular portion 11 is completely unrolled from the right reefing fingers 7. However, the piece-goods stack 2 has only partially already been wrapped, namely on the lateral sides thereof, with two bands 3 and 11 of tubular film, which bands are each very narrow but absorb high tensile forces.

The special characteristic of the wrapping produced in such a manner is that both tubular portions 3 and 11 have oblique pleatings 9 and 12 on the sides of the piece-goods stack 2, said pleatings being oriented in a crosswise manner to each other in the embodiment shown here. By means of the crosswise orientation of the pleatings 9 and 12, it is ensured that the tubular material arranged to an increased extent in the region of the pleatings 9, 12 leads to the tubular portion 3 or 11 reliably holding the piece-goods of the piece-goods stack 2 both in the vertical and horizontal direction. The two tubular portions 3 and 11 therefore act as two crossing tension bands. The piece-goods stack 2 is therefore secured according to the invention substantially more securely on the pallet 8 against slipping or by being subjected to braking during transportation than if said stack were to have been wrapped with a hood pulled smooth or with a band. This opens up completely new fields of use for stretch film packagings or shrink film packagings of piece-goods 2. In particular, it is now possible by means of the method according to the invention to package even higher stacks 2, for example made of flexible plastics bottles, with said method and to secure said stacks in position.

Figure 4:
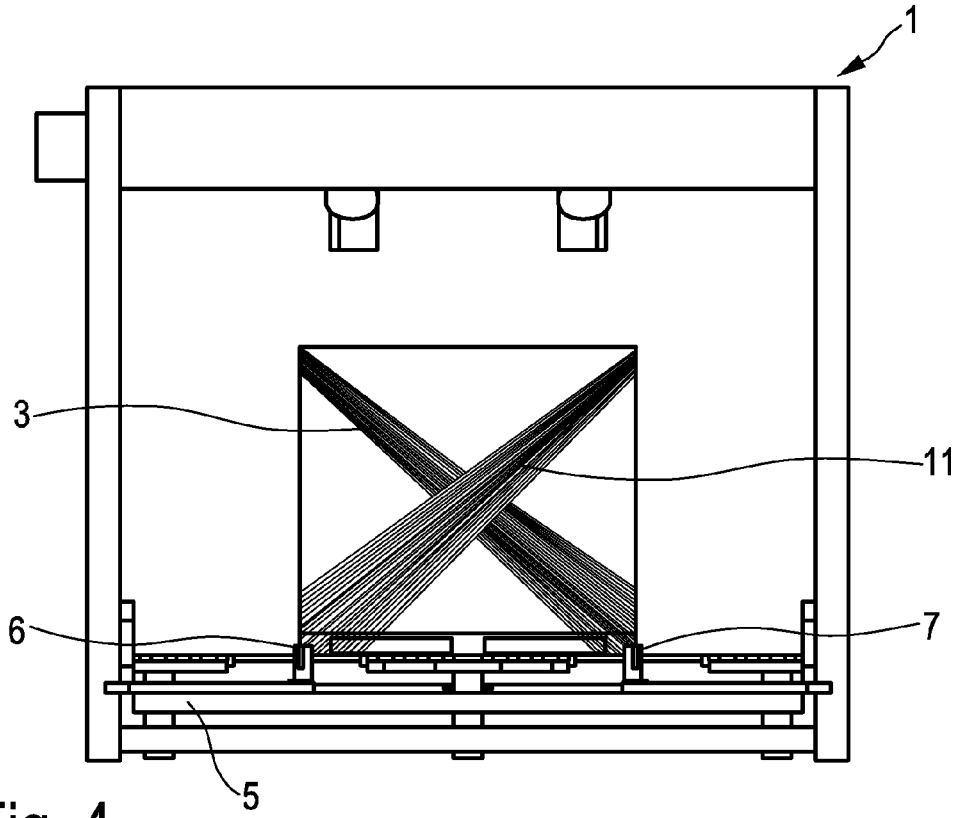
FIG. 4: shows a fourth exemplary embodiment of the invention, in which pleatings having a varying width are produced.
Figure 5:
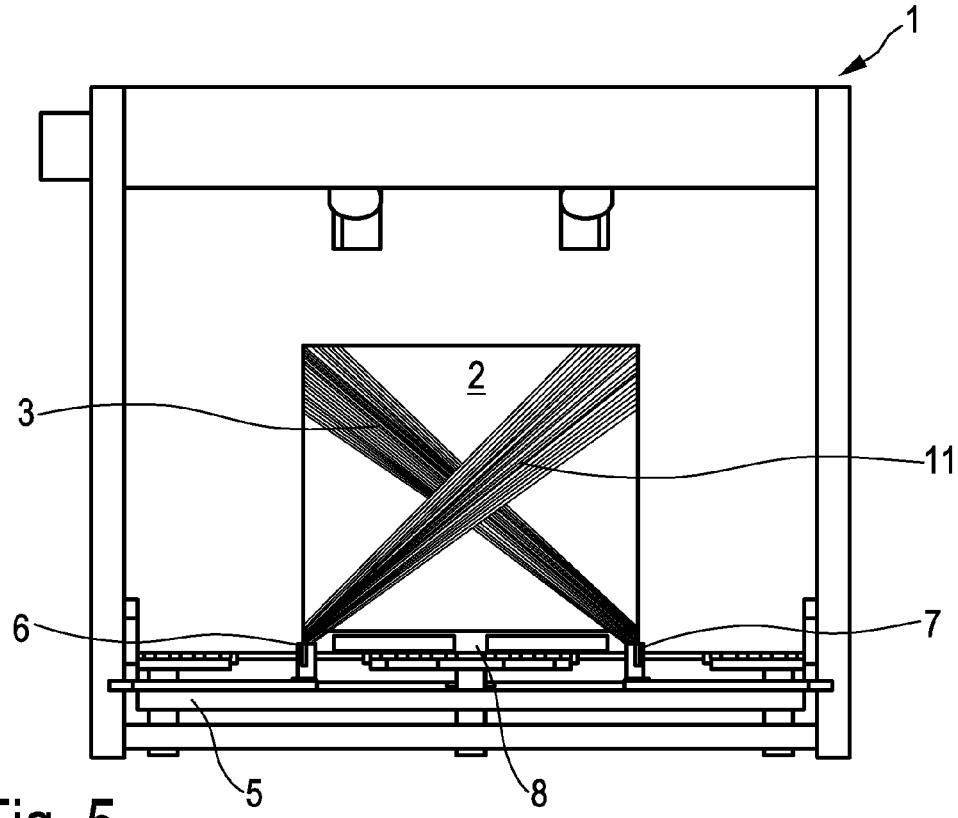
FIG. 5: shows a fifth exemplary embodiment of the invention with an alternative, fan-shaped pleating.

As can be gathered from the exemplary embodiments of FIG. 3, FIG. 4, FIG. 5 and FIG. 6, a plurality of tubular portions can be fixed to the stack 2 in a differing configuration and arrangement. In the exemplary embodiment shown in FIG. 3, the first tubular portion 3 and the second tubular portion 11 are each of relatively wide design while the variant embodiments according to FIG. 4 and FIG. 5 show fan-shaped pleatings 9 and 12. The widths of the pleatings 9 and 12 arise depending on the time at which the reefing rollers of the reefing device 4 run differently, or one reefing roller is stopped while the other reefing roller is driven.

Figure 6:
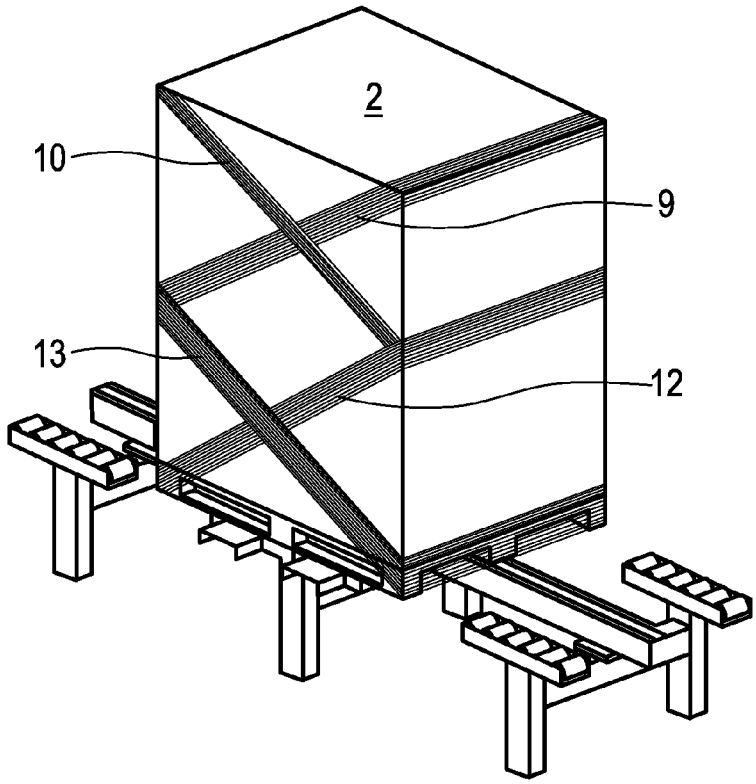
FIG. 6: shows a sixth exemplary embodiment of the invention, in which two crossing pleatings have been produced at different heights of the piece-goods stack.
Figure 7:
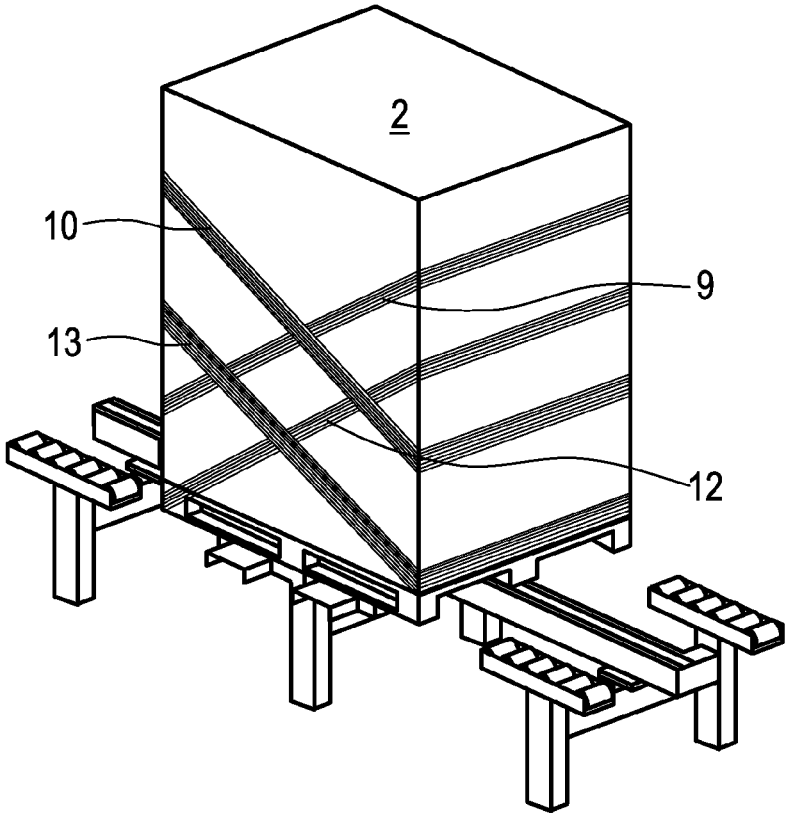
FIG. 7: shows a seventh exemplary embodiment of the invention, in which two crossing pleatings have been produced at different heights of the piece-goods stack.
Figure 8:
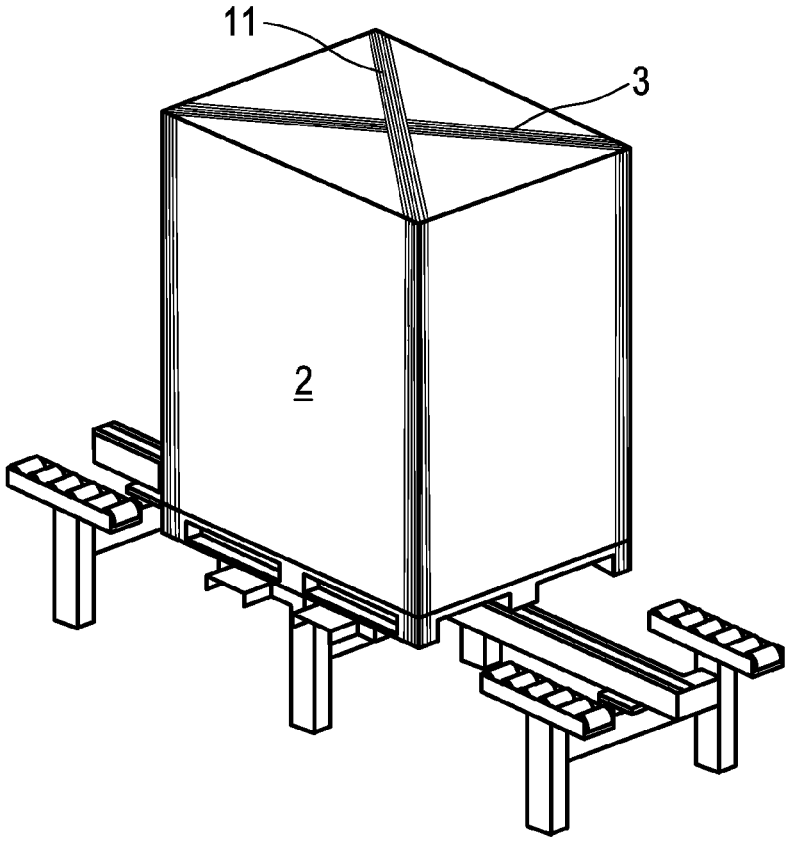
FIG. 8: shows an eighth exemplary embodiment of the invention, in which two crossing pleatings have been produced on the upper side of the piece-goods stack.

In principle, very different pleatings can be produced over the entire piece-goods stack 2, as can be gathered from the embodiments shown in FIG. 6, FIG. 7 and FIG. 8. In particular, a plurality of crossing tubular portions 3, 11 and pleatings 9, 10 and 12, 13 can also be produced by tubular portions (FIG. 6 and FIG. 7) 3 and 11 arranged one above the other on the stack 2.

As can be gathered from FIG. 8, the tubular portions 3, 11 and therefore the pleats 9, 10 can also be at least partially guided parallel to edges and corners of the piece-goods stack 2, in order to reinforce them.

LIST OF REFERENCE NUMBERS

1. Apparatus for at least partially wrapping a piece-goods stack
2. Piece-goods stack
3. Tubular portion
4. Reefing device
5. Reefing frame
6. Left reefing finger
7. Right reefing finger
8. Pallet
9. First pleating in the tubular portion 3
10. Second pleating in the tubular portion 3
11. Second tubular portion
12. First pleating in the tubular portion 11
13. Second pleating in the tubular portion 11

The invention claimed is:

1. A method for at least partially wrapping a piece-goods stack, in which a tubular portion is fixed to the piece-goods stack, wherein the tubular portion is fixed to the piece-goods stack in such a manner that, during the fixing operation, pleats are produced in the tubular portion said pleats extending obliquely over at least one side of the goods stack.

2. The method as claimed in claim 1, wherein the tubular portion is fixed to the piece-goods stack at least partially in a plurality of layers by the tubular portion initially being pulled and/or pushed over the piece-goods stack in a first drawing-over direction, then in an opposed, second drawing-over direction and subsequently optionally with further changes in direction.

3. The method as claimed in claim 2, wherein, following a change in the drawing-over direction, the orientation of the pleats in the tubular portion is changed.

4. The method as claimed in claim 2, wherein the pleats in the particular position of the tubular portion extend over the particular side of the goods stack in a crosswise manner to the preceding position.

5. The method as claimed in claim 1, wherein at least one further tubular portion is fixed on the piece-goods stack in such a manner that said tubular portion as far as possible has no pleats.

6. The method as claimed in claim 1, wherein at least one further tubular portion is pulled over the piece-goods stack in such a manner that pleats are produced in said tubular portion, the pleats preferably extending in a different direction from the pleats of the first tubular portion.

7. The method as claimed in claim 6, wherein the pleats of one tubular portion arranged over another extend in a crosswise manner to the pleats of the other tubular portion.

8. The method as claimed in claim 1,
wherein at least one tubular portion is arranged on another tubular portion.

9. The method as claimed in claim 1,
wherein at least one tubular portion is bonded to form a hood and is fixed to the piece-goods stack in the manner of a hood.

10. The method as claimed in claim 1,
wherein at least one tubular portion is fixed on the piece-goods stack in the manner of a band.

11. The method as claimed in claim 1,
wherein the width of the pleats of at least one tubular portion changes over the side of the piece-goods stack.

12. The method as claimed in claim 1,
wherein the pleats are produced only in a partial region of the tubular portion.

13. The method as claimed in claim 1,
wherein the pleats are produced in the tubular portion with the use of a reefing device which reefs and/or unreefs regions of the tubular portion at different speeds and/or at different times.

14. An apparatus for at least partially wrapping a piece-goods stack with a tubular portion, the apparatus having at least one reefing device for executing the method of claim 1, wherein the reefing device is configured in such a manner that it reefs and/or unreefs regions of the tubular portion at different speeds and/or at different times.

15. The apparatus as claimed in claim 14,
wherein the reefing device has at least two motors for reefing and unreefing a tubular portion, which motors can be activated separately.

16. The apparatus as claimed in claim 14,
wherein the reefing device has a reefing frame which has at least two frame halves which can be moved in the vertical direction separately from each other.

17. The apparatus as claimed in claim 14,
wherein the reefing device is configured in such a manner that it can pick up a plurality of tubular portions and can manipulate the latter in a drawing-over operation.

18. The apparatus as claimed in claim 14,
wherein the reefing device has at least one individually movable reefing finger.

19. The method as claimed in claim 1, wherein
the tubular portion has a longitudinal axis, and the pleats are located on one at least one side of the tubular portion, the at least one side being substantially parallel to a direction of extension of the longitudinal axis.

20. The method as claimed in claim 1, wherein
the piece-goods are stacked in a stack direction, and the tubular portion extends in the direction of the stack direction, and the pleats are located on at least one side of the tubular portion, the at least one side being substantially parallel to the stack direction.

21. The method as claimed in claim 1, wherein
the at least one side is a longitudinal side of the piece-goods stack.

22. The method as claimed in claim 1, wherein
respective pleats extend completely from one edge of the side to another edge of the side.

23. The method as claimed in claim 1, wherein
respective pleats extend completely from a first edge of the side to a second edge of the side opposite the first edge.

24. The method as claimed in claim 1, wherein
a side of the piece-goods stack is substantially rectangular, and respective pleats extend completely from one edge of the rectangle to another edge of the rectangle.

25. The method as claimed in claim 1, wherein
a side of the piece-goods stack is substantially rectangular, and respective pleats extend completely from one edge of the rectangle to another edge of the rectangle opposite the one edge.

* * * * *

UNITED STATES PATENT AND TRADEMARK OFFICE

CERTIFICATE OF CORRECTION

PATENT NO. : 8,887,478 B2
APPLICATION NO. : 13/825215
DATED : November 18, 2014
INVENTOR(S) : Per Lachenmeier et al.

It is certified that error appears in the above-identified patent and that said Letters Patent is hereby corrected as shown below:

IN THE CLAIMS

In Claim 1, Column 8, Line 36, between “the” and “goods” insert --piece--.
In Claim 4, Column 8, Line 51, replace the second instance of “the” with --a--.
In Claim 4, Column 8, Line 52, replace the first instance of “the” with --a--.
In Claim 4, Column 8, Line 53, replace “the” with --a--.
In Claim 11, Column 9, Line 12, replace the first instance of “the” with --a--.
In Claim 15, Column 9, Line 31, replace “a” with --the--.
In Claim 19, Column 10, Line 10, delete “one”.

Signed and Sealed this
Thirty-first Day of March, 2015

Michelle K. Lee

Michelle K. Lee
*Director of the United States Patent and Trademark Office*